US008113642B2

(12) United States Patent
Akiyama et al.

(10) Patent No.: US 8,113,642 B2
(45) Date of Patent: Feb. 14, 2012

(54) LIQUID EJECTION HEAD

(75) Inventors: Rumi Akiyama, Kawasaki (JP); Shingo Nagata, Kawasaki (JP); Hidehiko Kanda, Yokohama (JP); Atsushi Sakamoto, Kawasaki (JP); Hirokazu Tanaka, Kawasaki (JP); Wakako Yamamoto, Sagamihara (JP)

(73) Assignee: Canon Kabushiki Kaisha, Tokyo (JP)

( * ) Notice: Subject to any disclaimer, the term of this patent is extended or adjusted under 35 U.S.C. 154(b) by 414 days.

(21) Appl. No.: 12/364,795

(22) Filed: Feb. 3, 2009

(65) Prior Publication Data

US 2009/0201354 A1 Aug. 13, 2009

(30) Foreign Application Priority Data

Feb. 8, 2008 (JP) ..... 2008-029225
Jan. 6, 2009 (JP) ..... 2009-000868

(51) Int. Cl.
*B41J 2/175* (2006.01)
*B41J 2/17* (2006.01)
*B41J 2/19* (2006.01)

(52) U.S. Cl. ..... 347/93; 347/84; 347/92
(58) Field of Classification Search ..... 347/93, 347/84, 87, 92, 56, 61, 22
See application file for complete search history.

(56) References Cited

U.S. PATENT DOCUMENTS

| | | | | | |
|---|---|---|---|---|---|
| 5,463,413 | A * | 10/1995 | Ho et al. | ..... | 347/65 |
| 5,734,399 | A * | 3/1998 | Weber et al. | ..... | 347/65 |
| 6,007,188 | A * | 12/1999 | MacLeod et al. | ..... | 347/65 |
| 6,502,927 | B2 * | 1/2003 | Nozawa | ..... | 347/65 |
| 6,830,317 | B2 * | 12/2004 | Tsuchii et al. | ..... | 347/56 |
| 7,370,944 | B2 * | 5/2008 | Cabal et al. | ..... | 347/65 |
| 2002/0063752 | A1 * | 5/2002 | Clark | ..... | 347/48 |

FOREIGN PATENT DOCUMENTS

| | | | |
|---|---|---|---|
| JP | 06-246931 | | 9/1994 |
| JP | 2002254646 | A * | 9/2002 |
| JP | 2004-090292 | | 3/2004 |

* cited by examiner

*Primary Examiner* — Stephen Meier
*Assistant Examiner* — Leonard S Liang
(74) *Attorney, Agent, or Firm* — Fitzpatrick, Cella, Harper & Scinto

(57) ABSTRACT

The present invention provides a liquid ejection head which includes a plurality of ejection ports 302 arranged so as to form an ejection port row and which, after a recovery process of expanding and transferring a bubble toward an ink supply port, allows the bubble to be smoothly removed from a nozzle 310. electrothermal transducing elementA plurality of nozzle filters 306 are arranged between an ink supply port and the ink channel 304 so that ink supplied to the bubbling chamber 303 through the ink supply port is passed between the nozzle filters 306 to separate impurities contained in the ink, from the ink. When a distance between an ink channel inlet 311 and the nozzle filter 306 is defined as L1 and a distance between the adjacent nozzle filters 306 is defined as L2, a relationship between L1 and L2 satisfies L1≦L2.

4 Claims, 10 Drawing Sheets

LIQUID EJECTION HEAD

BACKGROUND OF THE INVENTION

1. Field of the Invention

The present invention relates to a liquid ejection head that ejects a liquid to a print medium, and in particular, to a liquid ejection head suitable for a recovery process for the liquid ejection head.

2. Description of the Related Art

In ink jet printing apparatuses, a recovery process is carried out in order to, in most cases, discharge high viscosity ink, fine bubbles, and the like from a print head serving as a liquid ejection head and remove impurities, ink mist, and the like which are attached to a surface with ejection ports formed therein. The recovery process is performed to keep good condition of ink ejection from the print head. A sucking operation, a preliminary ejecting operation, a wiping operation, and the like are known as the recovery process. The sucking operation is performed by capping an ejection port forming surface of the print head and using a suction pump or the like to form a negative pressure in the cap. Thus, the high viscosity ink and bubbles are sucked out through the ejection ports of the print head together with normal ink. In preliminary ejecting operation, ink not involved in image formation is ejected to a particular place other than the print medium. Then, the high viscosity ink and bubbles are discharged through the ejection ports in the print head. If inks of different colors are mixed in the cap during the sucking operation, the preliminary ejecting operation is performed to enable the mixed color inks to be removed from the print head. The wiping operation is performed by using a blade to wipe the surface of the print head in which the ejection ports are formed. This removes the impurities, ink mist, and the like attached to the surface with the ejection ports formed therein.

If bubbles (hereinafter referred to as nozzle bubbles) remain in nozzles in the print head after the ink ejection, then during ink ejection for formation of the next image, an ejection pressure may be absorbed by the bubbles. This may result in a phenomenon such as non-ejection, a shift in ejecting direction, or a decrease in the amount of ejected liquid below an appropriate value. This may reduce the accuracy with which the ink impacts the print medium at a predetermined position. As a result, the quality of the resulting image obtained by printing may be degraded. To prevent bubbles from remaining inside a bubbling chamber as described above, conventional techniques may perform the sucking operation based on the negative pressure followed by the preliminary sucking operation, as an example of the recovery process.

However, with such a conventional recovery process, the sucking operation may disadvantageously involve a large amount of waste ink and cause most of the ink available for printing to be discharged. Thus, various recovery process methods have been proposed to reduce the amount of waste ink resulting from the recovery process.

An ink jet printing apparatus employing such a recovery process is disclosed in, for example, Japanese Patent Laid-Open No. H06-246931 (1994). During the preliminary ejection, the ink jet printing apparatus in Japanese Patent Laid-Open No. H06-246931 (1994) adjusts the number of ink ejections according to conditions such as the type of ink and the temperature inside the print head, or the like. During the preliminary ejection, first, the type of ink, the temperature inside the print head, and the like are determined. Then, according to these conditions, the number of ejection droplets is read from a memory. The preliminary ejection is then preformed according to the set number of ejection droplets. This inhibits generation of an excessive amount of waste ink, thus allowing the preliminary ejection to be appropriately performed.

Japanese Patent Laid-Open No. 2004-090292 discloses an ink jet printing apparatus including a plurality of ejection ports with different ink ejection amounts, the apparatus adjusting driving conditions for an energy element during the preliminary ejection for each ejection port according to the amount of ink ejected through the ejection port. Japanese Patent Laid-Open No. 2004-090292 discloses means for setting the driving conditions to be adjusted, specifically, the number of ejection droplets, an ejection frequency, and an ejection interval. Thus, setting proper driving conditions for the ejection ports with different characteristics allows a reduction in the amount of ink required for the preliminary ejection.

However, if the recovery process for removing the bubble remaining in the nozzle is carried out by performing the sucking operation and then the preliminary ejecting operation, ink consumption associated with the recovery process is unavoidable. Thus, a recovery process for removing the bubble from the nozzle is required which process involves no ink consumption.

In connection with the ink consumption associated with the recovery process, a method for carrying out the recovery process while inhibiting the ink consumption has been proposed which method heats the print head to generate and expand a bubble so that the bubble is transferred from the bubbling chamber toward an ink supply port and is thus removed from the bubbling chamber. Thus, the bubble is removed from the bubbling chamber to allow the ink to be smoothly ejected. The method also allows the nozzle recovery process to be carried out without consuming ink, thus reducing the amount of ink consumed.

However, the recovery process of expanding and transferring the bubble inside the bubbling chamber toward the ink supply port as described above may be employed for a print head in which a plurality of ejection ports are arranged in a direction parallel to a direction in which the ink supply port extends, so as to form ejection port rows. In connection with this, the present inventors have found the following. If the recovery process is carried out in the print head including the ejection port rows formed therein and extending parallel to the extending direction of the ink supply port, when an expanded bubble generated in a nozzle transfers toward the ink supply port, the bubble may be combined to another bubble generated in the adjacent nozzle. Then, the combination of the bubbles may cause the bubble to remain inside the bubbling chamber, thus affecting the ink ejection.

SUMMARY OF THE INVENTION

Thus, in view of the above-described circumstances, an object of the present invention is to provide a liquid ejection head which includes a plurality of ejection ports arranged so as to form an ejection port row and which, after a recovery process of expanding and transferring a bubble toward an ink supply port, allows the bubble to be smoothly removed from a nozzle.

The first aspect of the present invention is a liquid ejection head comprising: a plurality of nozzles each including: an energy acting chamber; a print element located in the energy acting chamber to generate energy applied to a liquid stored in the energy acting chamber; an ejection port which communicates with the energy acting chamber and through which the liquid to which the energy is applied by the print element is ejected; and a liquid channel through which the liquid supplied via a liquid supply port and stored in the energy acting chamber passes, wherein a plurality of nozzle filters are provided between the liquid supply port and the liquid channel so that the liquid supplied to the energy acting chamber through the liquid supply port is passed between the nozzle filters to separate an impurity contained in the liquid, from the liquid, when a distance, in a direction from the liquid supply port toward the ejection port, between the nozzle filter and a liquid channel inlet that is closest to the liquid supply port in the liquid channel is defined as L1, and a distance between the nozzle filters is defined as L2, a relationship between L1 and L2 satisfies L1≦L2.

The second aspect of the present invention is a liquid ejection head comprising: a plurality of nozzles each including: an energy acting chamber; a print element located in the energy acting chamber to generate energy applied to a liquid stored in the energy acting chamber; an ejection port which communicates with the energy acting chamber and through which the liquid to which the energy is applied by the print element is ejected; and a liquid channel through which the liquid supplied via a liquid supply port and stored in the energy acting chamber passes, wherein a plurality of nozzle filters are provided between the liquid supply port and the liquid channel so that the liquid supplied to the energy acting chamber through the liquid supply port is passed between the nozzle filters to separate an impurity contained in the liquid, from the liquid, flow resistance in a channel between the nozzle filter and the liquid channel inlet which is closest to the liquid supply port in the liquid channel is higher than that in a channel between the nozzle filters.

The present invention can provide the liquid ejection head which includes the plurality of ejection ports arranged so as to form the ejection port row and which, after the recovery process of expanding and transferring the bubble toward the ink supply port, allows the bubble to be smoothly removed from the nozzle.

Further features of the present invention will become apparent from the following description of exemplary embodiments (with reference to the attached drawings).

DESCRIPTION OF THE EMBODIMENTS

An embodiment of the present invention will be described with reference to the accompanying drawings.

Figure 1:
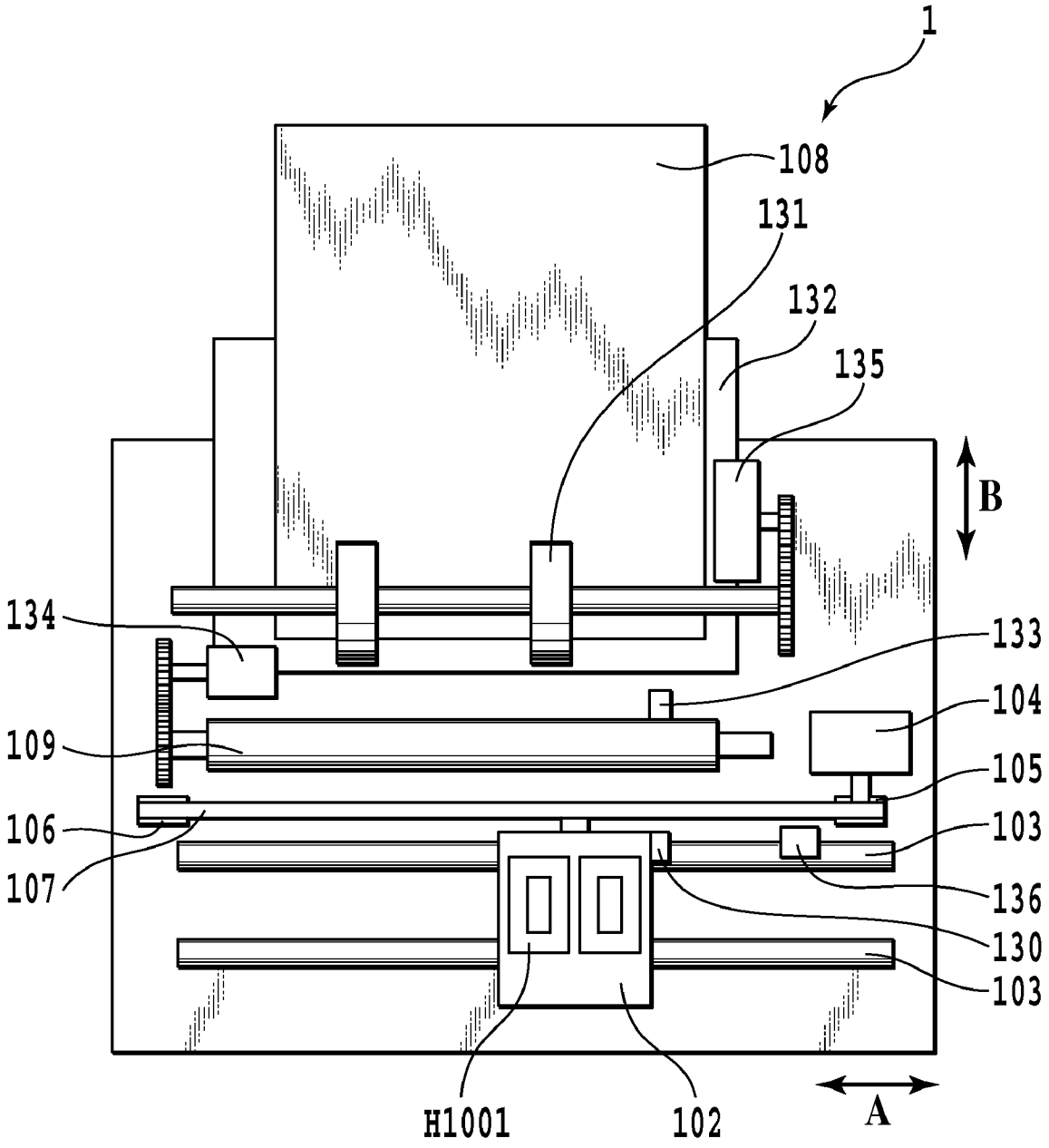
FIG. 1 is a plan view of a printing apparatus according to an embodiment of the present invention.

First, a configuration of a printing apparatus that is an ink jet printing apparatus employing a print head according to the present embodiment will be described. A printing apparatus 1 according to the present embodiment is configured to allow a print head H1001 that is an ink jet print head of a cartridge type to be mounted therein. FIG. 1 is a plan view of the printing apparatus 1 based on an ink jet scheme according to the present embodiment.

The printing apparatus 1 shown in FIG. 1 is based on a serial scan scheme. A carriage 102 is supported so as to be reciprocatable along a guide shaft 103 extending in a main scanning direction (the direction of arrow A shown in FIG. 1) of the printing apparatus 1 and installed in an apparatus body. The carriage 102 is driven by a main scanning motor 104 via a driving mechanism including a motor pulley 105, a driven pulley 106, and a timing belt 107, or the like. This allows the position of the carriage 102 and movement thereof to be controlled. Furthermore, a home position sensor is provided on the carriage 102. Thus, when passing over the position of a shield 136, the home position sensor 130 senses passage over the shield 136 on the carriage 102. The home position sensor 130 can thus sense that the carriage 102 is at a home position.

Print media such as print sheets or thin plastic sheets are placed on a sheet feeding tray provided in the printing apparatus 1. The print media are then conveyed by a feeding roller in a sub-scanning direction shown by arrow B in FIG. 1. Driving of a sheet feeding motor 135 rotates a pickup roller 131 via a gear to separate a print medium 108 from the remaining print media and feed the separated print medium 108 from an auto sheet feeder (ASF) 132. Then, a conveying roller 109 is rotated to convey the print medium 108 (sub-scanning) through a position (print area) located opposite an ejection port surface of the print head H1001. The conveying roller 109 is rotationally driven by a rotating LF motor 134 via a gear. At this time, a paper end sensor 133 determines whether or not any print medium has been fed and also determines a head position for sheet feeding. These determinations are performed when the print medium 108 passes by the paper end sensor 133. The paper end sensor 133 further senses where a trailing end of the print medium 108 actually is. The paper end sensor 133 is also used to determine the current print position based on the actual trailing end of the print medium 108.

The printing apparatus 1 repeats a printing operation and a conveying operation of conveying the sheet in the sub-scanning direction by a distance corresponding to a print width for the printing operation, to sequentially print images on the sheet. The printing operation is performed by ejecting ink to a print area on the print medium 108 on a platen while moving the print head in the main scanning direction.

The present invention is also applicable to a full line-type printing apparatus that uses an elongate print head extending over the entire area of the print medium in a width direction thereof.

During printing, a back surface of the print medium 108 is supported by the platen (not shown in the drawings) so that the print medium 108 forms a flat print surface in the print area. At this time, the ejection port surface of the print head H1001, mounted on the carriage 102 and serving as a liquid ejection head, is located so as to protrude downward from the carriage 102. The print head H1001 is held in the carriage 102 so that between two pairs of conveying rollers, the ejection port surface lies opposite and parallel to the print area on the print medium 108. Thus, the print head H1001 is replaceably mounted and positioned on the carriage 102 in the printing apparatus 1 in FIG. 1. The carriage 102 includes an electric connection section that transmits driving signals and the like to each ejection sections via external signal input terminals on the print head H1001. The print head H1001 is mounted on the carriage 102 so that a direction in which the ejection ports are arranged is orthogonal to the main scanning direction of the carriage 102.

Figure 2A:
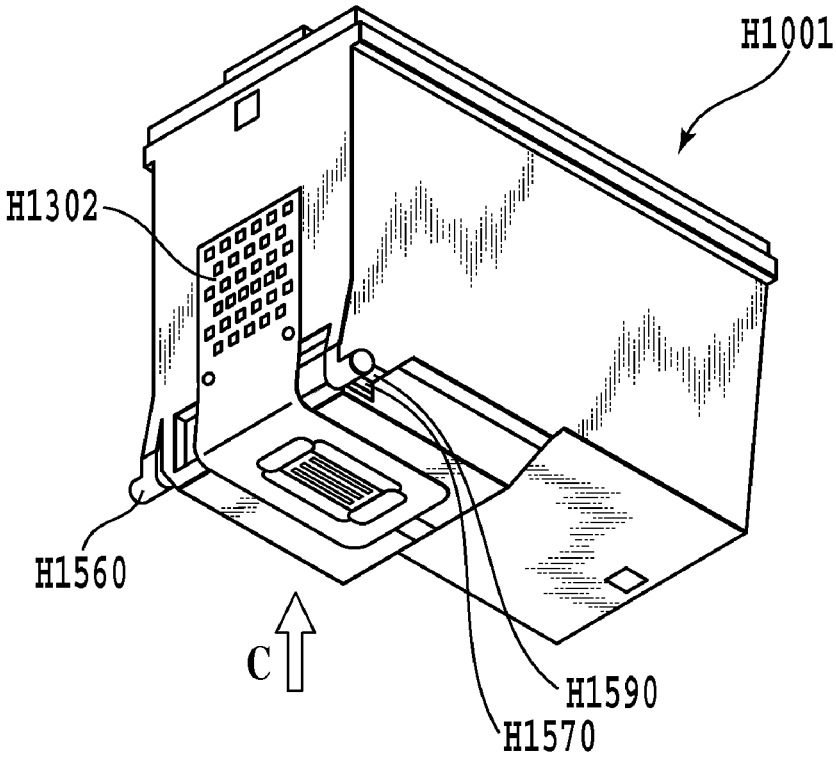
FIG. 2A is a perspective view of a print head mounted in the printing apparatus in FIG. 1 and as viewed from obliquely below.
Figure 2B:
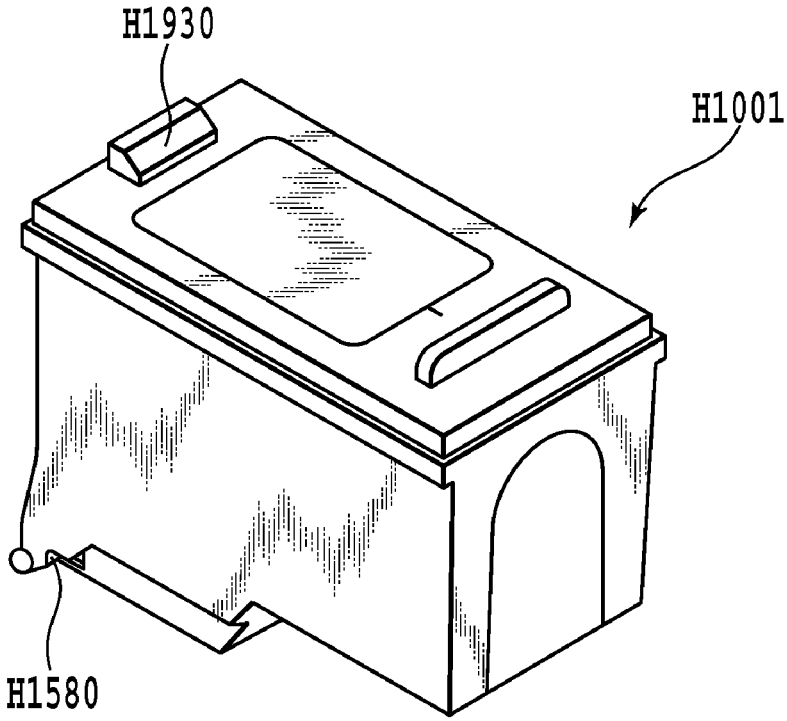
FIG. 2B is a perspective view of the print head mounted in the printing apparatus in FIG. 1 and as viewed from obliquely above.
Figure 3A:
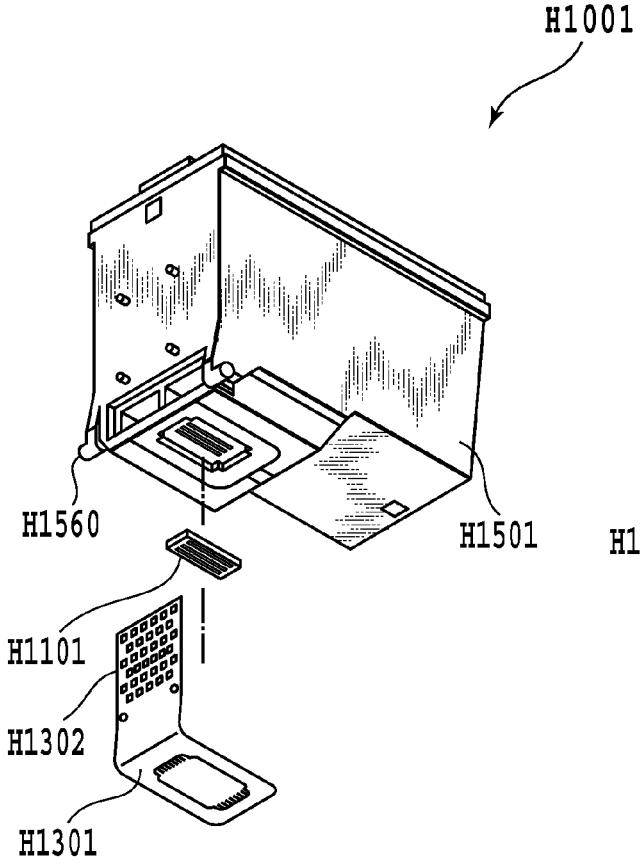
FIG. 3A is an exploded perspective view of the print head in FIGS. 2A and 2B as viewed from obliquely below.
Figure 3B:
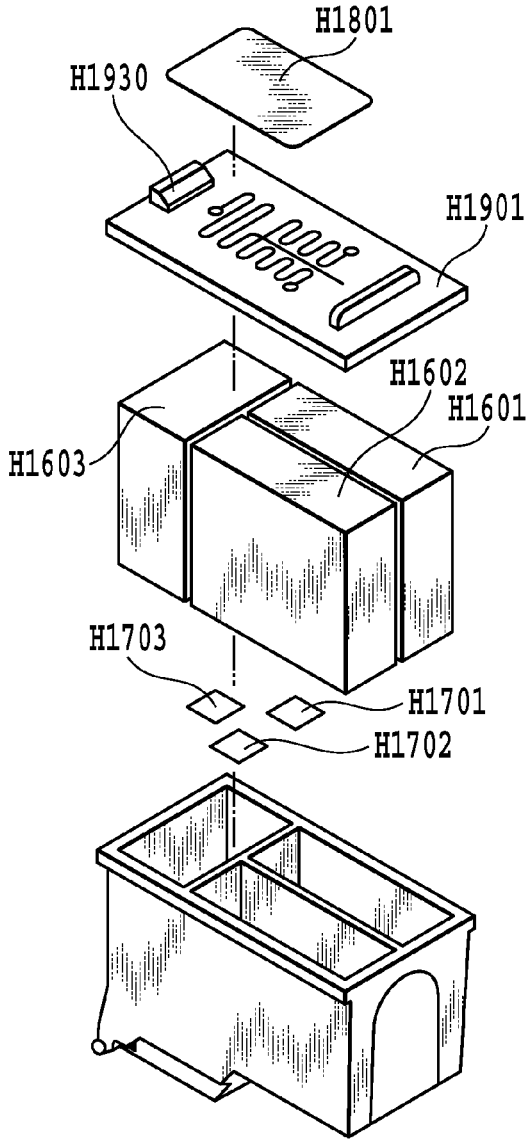
FIG. 3B is an exploded perspective view of the print head in FIGS. 2A and 2B as viewed from obliquely above.

FIGS. 2A and 2B show perspective views illustrating the whole print head H1001, mounted in the printing apparatus 1 via the carriage 102. FIG. 2A shows a perspective view of the print head H1001 as viewed from obliquely below. FIG. 2B shows a perspective view of the print head H1001 as viewed from obliquely above. FIGS. 3A and 3B shows perspective views of the print head H1001 disassembled into components. FIG. 3A shows a perspective view of the print head H1001 as viewed from obliquely below. FIG. 3B shows a perspective view of the print head H1001 as viewed from obliquely above. The print head H1001 will be described with reference to these drawings.

The print head H1001 as an ink jet print head according to the present embodiment is based on a bubble jet (registered trade mark) scheme and uses electrothermal transducing elements that generate thermal energy required to subject ink inside a bubbling chamber to film boiling in response to an electric signal. In addition, the print head H1001 according to the present embodiment is of what is called a side shooter type in which each of the electrothermal transducing elements is located opposite the corresponding ejection port, through which ink droplets are ejected.

As shown in the exploded perspective view in FIG. 3A, the print head H1001 according to the present embodiment includes a print element substrate H1101, an electric wiring tape H1301, and an ink supply holding member H1501. As shown in the exploded perspective view in FIG. 3B, the print head H1001 according to the present embodiment further includes filters H1701, H1702, and H1703, ink absorbers H1601, H1602, and H1603, a cover member H1901, and a seal member H1801.

For distribution, a protective tape (not shown in the drawings) is attached and stuck to a front face of the ejection port surface of the print head H1001 so as to block the ejection ports formed in the print element substrate H1101 of the print head H1001 of the cartridge type as described above. Thus, the print head H1001 is sealed so as to prevent ink filled in the ink supply holding member H1501 of the print head H1001 from leaking through the ejection ports in the print head H1001. Here, the configuration of the print head that can eject three types of ink is described. However, the print head according to the present invention is not limited to this aspect. The number of ink types need may be four or more, or two or less instead of three. Furthermore, ink colors are not limited to yellow, cyan, and magenta, but any other color ink may be used. The ink need not develop a color for printing but may be a liquid used to treat the ink or the print medium. Here, the treatment of the ink or the print medium refers to, for example, improvement of fixability by cohesion or insolubilization of a color material in the ink provided to the print medium, improvement of print quality or color developing capability, and improvement of image durability or the like.

As shown in FIG. 2A, the print head H1001 according to the present embodiment includes an installation guide H1560 and an engagement portion H1930. The installation guide H1560 is formed to guide the print head H1001 being installed, to the installation position of the carriage 102 in the ink jet printing apparatus body to allow the print head H1001 to be accurately mounted at a predetermined position in the printing apparatus 1. When the print head H1001 is installed in the printing apparatus body, the engagement portion H1930 is engaged with a head set lever and thus fixedly installed on the carriage 102. The print head H1001 further includes an abutting portion H1570 for the main scanning direction, an abutting portion H1580 for the sub-scanning direction, and an abutting portion H1590 for an ink ejection direction; the abutting portions H1570, H1580, and H1590 are provided in proximity to the installation guide H1560. The abutting portions H1570, H1580, and H1590 are formed to allow the print head H1001 to be positioned at a predetermined installation position of the carriage 102. The abutting portion H1590 allows the print head H1001 to be positioned with respect to the carriage 102. Thus, external signal input terminals H1302 on the electric wiring tape H1301 are electrically contacted accurately with contact pins in the electric connection section, provided in the carriage.

Now, a configuration of the print head H1001 will be described.

Figure 4:
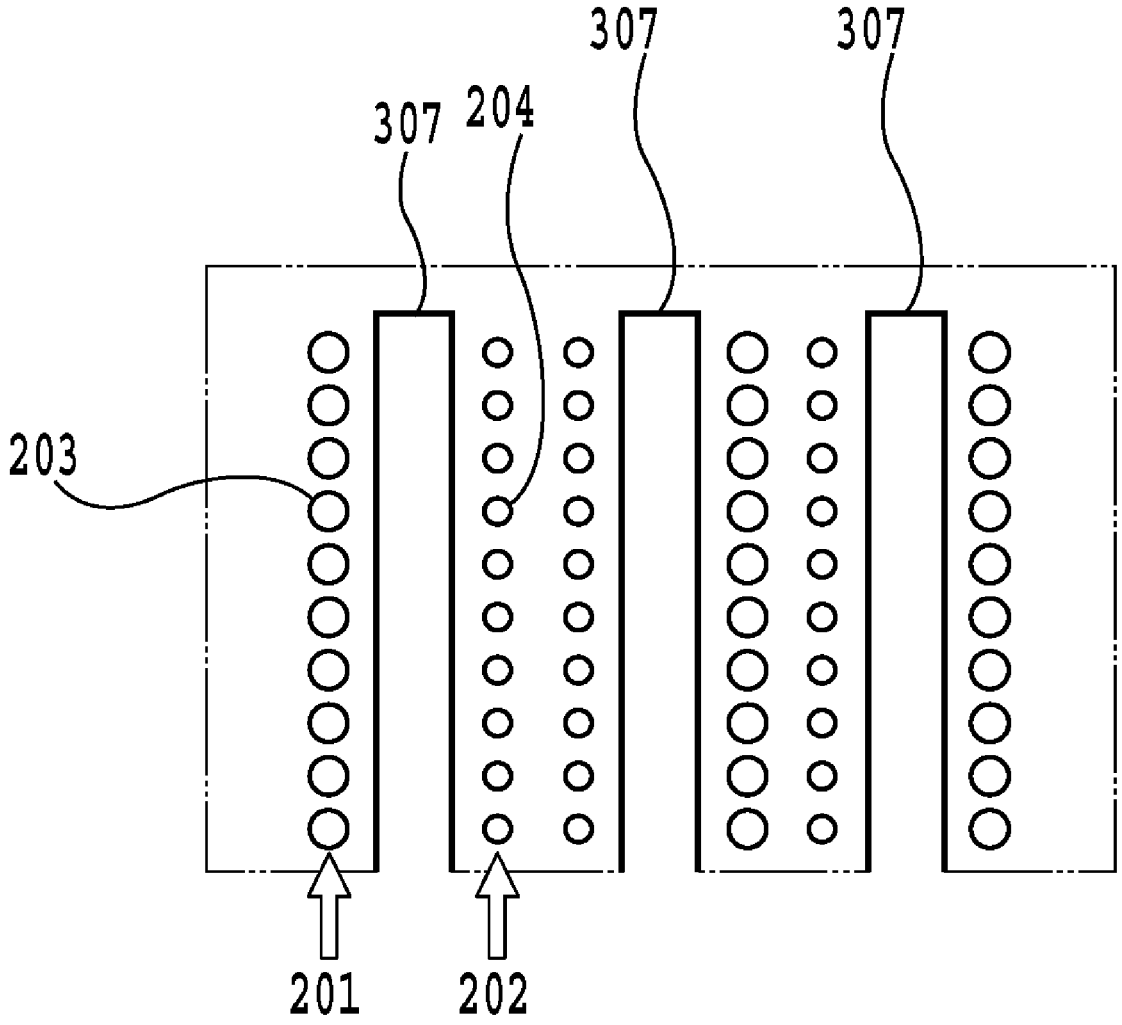
FIG. 4 is a plan view of an ejection port forming surface of the print head in FIGS. 2A and 2B.

FIG. 4 shows a schematic plan view of the ejection port forming surface of the print head H1001 according to the present embodiment in which surface the ejection ports are formed. The ejection port forming surface of the print head H1001 shown in FIG. 4 includes an arrangement of the ejection ports on the print element substrate H1101 observed when the print head H1001 in FIG. 2A is viewed in the direction of arrow C. The schematic plan view of the ejection port forming surface shown in FIG. 4 virtually shows ink supply ports 307. The ink supply ports 307 are formed in the print element substrate H1101. Ink stored in the ink supply holding member H1501 is supplied to each of the nozzles 310 via the respective ink supply ports 307. Each of the ink supply ports 307 has a generally rectangular shape extending long in the sub-scanning direction. Three rows of the ink supply port 307 are formed in the print element substrate H1101. The print head H1001 includes two types of ejection ports 203 and 204; a relatively large amount of ink is ejected through each of the first ejection ports 203, and a relatively small amount of ink is ejected through each of the second ejection ports 204. In the present embodiment, the first ejection port 203 is formed to be able to eject 5 pl of droplets. The first ejection ports 203 are arranged parallel to the ink supply port 307 to form a first ejection port row 201. The second ejection port 204 is formed to be able to eject 2 pl of droplets. The second ejection ports 204 are arranged parallel to the ink supply port 307 to form a second ejection port row 202.

In this case, the amount of ink droplets ejected through the ejection port need not be exactly 5 pl or 2 pl for all the ejection ports making up each of the ejection port rows 201 and 202. The ejection ports in each ejection port row have only to have a size appropriate to eject substantially about 5 pl or 2 pl of ink droplets. All the ejection port rows 201 and 202 extend parallel to the direction in which the ink supply ports 307 extend.

The three rows of the ink supply port 307 are independently connected to respective ink tank sections. Thus, storing different types of ink in the respective three ink tank sections allows the three rows of the ink supply port 307 to be supplied with the different types of ink. As a result, the different types of ink can be supplied through the ejection ports connected to the respective three rows of the ink supply port 307. In the present embodiment, the three types of color ink in cyan, magenta, and yellow are set to be ejected through the ejection ports. The amount of ink ejected through the ejection port per ejection is not limited to 5 pl or 2 pl. A different ejection amount may be set.

Figure 5:
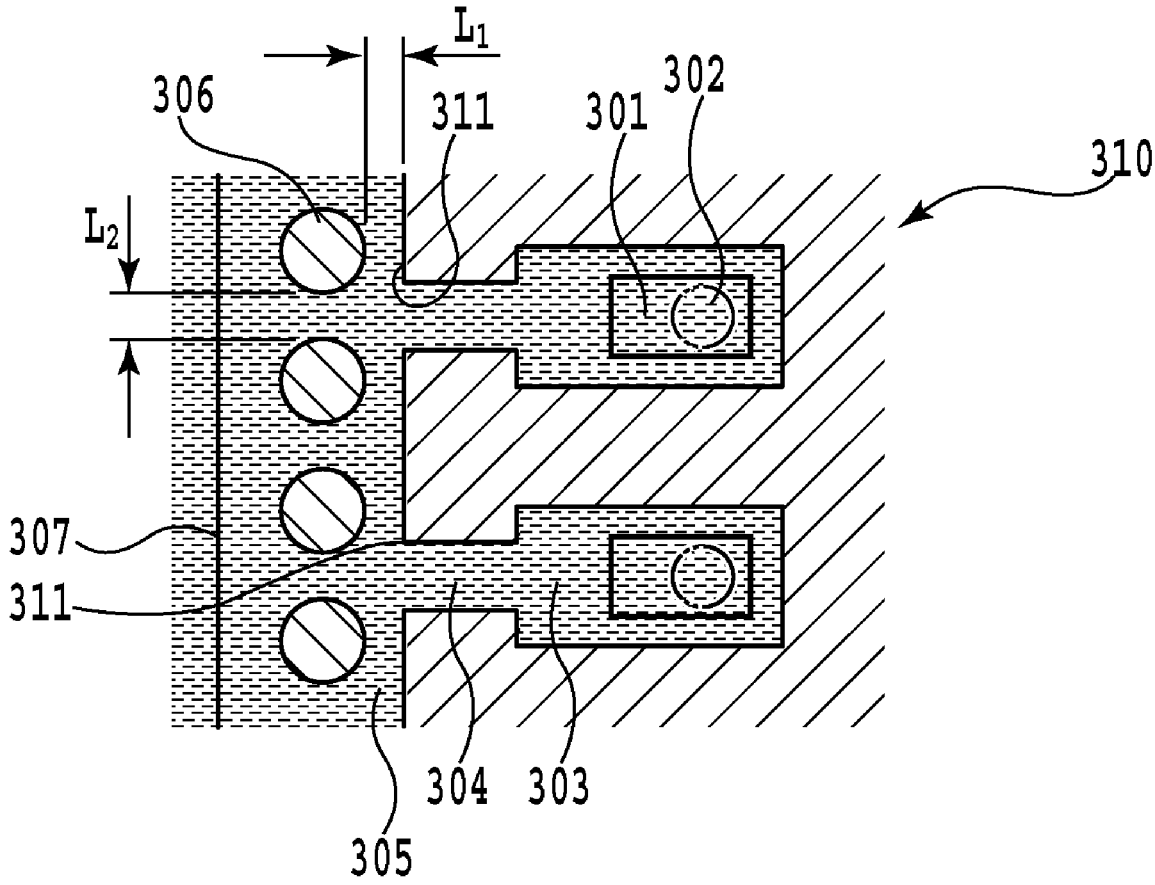
FIG. 5 is an enlarged sectional view of an essential part of the print head in FIG. 4.

FIG. 5 shows a sectional view of a nozzle shape, showing an enlarged essential part of one of the second ejection port row 202, one of the ejection port rows 201 and 202 formed in the print head H1001. Here, the second ejection port row 202 is shown by way of example. The first ejection port row 201 has the same structure as that of the second ejection port row 202 except for the dimensions of relevant portions. Each of the ejection ports 302 making up the second ejection port row 202 is formed to have an area enabling 2 pl of ink droplets to be ejected through the ejection port 302. Specifically, a cross section of the ejection port 302 is shaped like a circle of diameter 10.4 μm. A bubbling chamber 303 which communicate with the ink ejection port 302, an ink channel 304, and an electrothermal transducing element 301 are formed to have dimensions adjusted to the ink ejection amount of 2 pl. Specifically, the bubbling chamber 303 is formed to have a width of 22 μm. The ink channel 304 is formed to have a width of 11 μm.

The print head H1001 includes the ejection port rows 201 and 202 and thus a plurality of nozzles 310. Each of the nozzles 310 includes the bubbling chamber 303, serving as an energy acting chamber, the electrothermal transducing element 301, serving as a print element, the ejection port 302, through which ink is ejected, and the ink channel 304, serving as a liquid channel. The bubbling chamber 303 temporarily internally stores the ink, that is, a liquid ejected through the ejection port 302. The electrothermal transducing element 301 is located in the bubbling chamber 303 to generate energy applied to the ink stored in the bubbling chamber 303. The ejection port 302 communicates with the bubbling chamber 303. The ink to which the energy is applied by the electrothermal transducing element 301 is ejected trough the ejection port 302. The ink supplied via the ink supply port 307, which is a liquid supply port, and temporarily stored in the bubbling chamber 303 is fed into the bubbling chamber 303 through the ink channel 304.

The electrothermal transducing element 301 is located inside the bubbling chamber 303 opposite the ejection port 302. The electrothermal transducing element 301 is shaped like a rectangle of 13×22.4 μm. The ink channel 304 is formed to communicate with a common liquid chamber 305. The common liquid chamber 305 is positioned closer to a front surface side corresponding to a direction in which the ink is ejected, than the ink supply port 307. The common liquid chamber 305 is formed so as to cover the ink supply port 307.

Now, arrangement of a nozzle filter will be described.

A nozzle filter 306 is located in an area inside the common liquid chamber 305 and outside the ink supply port 307. A plurality of the nozzle filters 306 are arranged between the ink supply port 307 and the ink channel 304. The nozzle filters 306 are provided for the following purpose. The ink supplied to the bubbling chamber 303 through the ink supply port 307 is passed among the nozzle filters 306 so that the nozzle filters 306 can separate impurities contained in the ink, from the ink. That is, if the ink supplied to the nozzle through the ink supply port 307 contains dirt or the like, the nozzle filters 306 trap the dirt. That is, the nozzle filters 306 are provided in order to, for example, inhibit possible flow of the dirt or the like in the ink into the nozzle 310.

In the present embodiment, the nozzle filter 306 is a cylinder of diameter 14 μm. In the present embodiment, two nozzle filters 306 are formed per nozzle 310. That is, the two nozzle filters 306 are assigned to each nozzle 310.

Here, in the nozzle 310 according to the present embodiment, a distance, in an ink supply direction, between the nozzle filter 306 and an ink channel inlet 311 that is a liquid channel inlet through which the ink is fed from the ink supply port 307 into the nozzle 310 is defined as L1. A distance between the adjacent nozzle filters 306 is defined as L2. Here, the ink supply direction refers to a direction from the ink supply port 307 toward the ejection port 302. In this case, the nozzle 310 and the nozzle filter 306 are arranged and formed so as to satisfy a relationship $L1 \leqq L2$. In the present embodiment, the ink channel inlet 311 is a portion of the ink channel 304 which is closest to the ink supply port 307. In the present embodiment, L1 is 6 μm, and L2 is 7 μm.

Since one of the purposes of nozzle filters 306 is to trap such dirt as may block the ejection ports 302, both L1 and L2 are desirably smaller than an ejection port diameter in all the nozzles of the plurality of ejection ports making up the ejection port rows 201 and 202. In the present embodiment, since the relationship $L1 \leqq L2$ is satisfied, provided that L2 is smaller than the ejection port diameter, both L1 and L2 are smaller than the ejection port diameter. Thus, in the present embodiment, when the ejection port diameter of the ejection port is defined as d, a relationship $L2 < d$ is satisfied for all the nozzles.

Now, a recovery process using the print head H1001 according to the present embodiment will be described.

First, a driving signal is provided to the electrothermal transducing elements 301 by a short pulse so as to prevent the ink from being ejected through the ejection ports. Thus, the ink inside the bubbling chamber 303 is heated. When the temperature of the ink inside the bubbling chamber 303 thus rises, a bubble is expanded which remains inside the bubbling chamber 303 and which may affect ink ejection.

Here, to generate a negative pressure required to prevent possible ink leakage through the ejection ports, ink absorbers H1601, H1602, and H1603 that are spongy porous members are housed in the ink supply holding member H1501, in which the ink is accommodated. The ink supply port 307 is connected to the interior of the ink supply holding member H1501 via the ink channel 304. Thus, the interior of the ink supply holding member H1501 is at a lower pressure than the interior of the bubbling chamber 303. Consequently, when expanded, the bubble is pulled toward the lower pressure side. Furthermore, the expanded bubble is more likely to be affected by a difference in pressure. Therefore, the bubble transfers from the bubbling chamber 303 toward the ink supply port 307.

When installed on the carriage, the print head H1001 is generally mounted so as to face downward in a vertical direction so that the ejection ports in the print head lie opposite the print medium placed below the print head as in the case of the present embodiment. Thus, the ink channel from the ink supply port 307 extends upward and toward the ink supply holding member H1501. When the bubble reaches the ink supply port 307, since the channel extends upward to the ink supply holding member H1501, the bubble rises not only because of the above-described pull by the lower pressure portion but also because of buoyancy of the bubble. The bubble thus transfers toward the ink supply holding member H1501. The bubble having passed through the ink supply port 307 no longer affects the ink ejection during printing.

In the print head according to the present embodiment, a positional relationship between the nozzle filter 306 and the nozzle 310 is such that the nozzle 310 and the nozzle filter 306 are arranged so as to satisfy the relationship L1≦L2. Here, the distance L1 between the ink channel inlet 311 and the nozzle filter 306 corresponds to the width of the channel between the ink channel inlet 311 and the nozzle filter 306 as shown in FIG. 5. Furthermore, in the present embodiment, the two nozzle filters 306 are formed per nozzle, and the distance L2 between the nozzle filters 306 corresponds to the distance between the two nozzle filters 306. Thus, flow resistance in the channel between the ink channel inlet 311 and the nozzle filter 306 is higher than that in the channel between the nozzle filters 306. As a result, the ink flows through the channel between the nozzle filters 306 instead of the channel between the ink channel inlet 311 and the nozzle filter 306. Thus, the bubble formed and expanded inside the bubbling chamber 303 is more likely to transfer through the channel between the nozzle filters 306 than through the channel between the ink channel inlet 311 and the nozzle filter 306.

In this manner, the bubble passes between the nozzle filters 306 instead of passing through the channel between the ink channel inlet 311 and the nozzle filter 306. Thus, in transferring from the bubbling chamber 303 in a certain nozzle 310 toward the ink supply port 307, the bubble transfers to the ink supply port 307 without being combined with another bubble from the nozzle located adjacent to the certain nozzle 310. Consequently, the bubble from the certain nozzle transfers toward the ink supply port 307 while prevented from being combined with another bubble generated in the nozzle adjacent to the certain nozzle. During transferring, the bubble is thus inhibited from being combined with the bubble from the adjacent nozzle. This prevents the otherwise combined bubbles from remaining inside the nozzle 310. As a result, in the print head according to the present embodiment, the bubble efficiently exits the nozzle 310 to allow the recovery process to be smoothly carried out on the interior of the nozzle.

The recovery process of heating the ink to expand and transfer the bubble can be performed as described above. Thus, the bubble remaining in the bubbling chamber 303 can be removed. This prevents the bubble from remaining in the bubbling chamber 303, allowing the ink ejection to be achieved with a high impacting accuracy without being affected by the bubble. Thus, an output image resulting from printing maintains high quality.

Furthermore, since the nozzle filter 306 and the nozzle 310 are arranged in the above-described positional relationship, the bubbles in the bubbling chamber can be removed without the need for another recovery process such as the preliminary ejection, which consumes the ink. Thus, the consumption of the ink involved in the recovery process can be reduced. This reduces the costs of the use of a printing apparatus with the print head mounted therein. Consequently, a printing apparatus with reduced operation costs can be provided. Furthermore, the amount of waste ink can be minimized, allowing an environmentally-friendly printing apparatus to be provided.

Moreover, both L1 and L2 are set to be smaller than the ejection port diameter in all the nozzles of the plurality of ejection ports making up the ejection port row. Thus, the nozzle filters trap dirt or the like having such a size as blocks the ejection ports to affect the ink ejection. Consequently, dirt or the like having a length larger than L2 is prevented from flowing into the bubbling chamber. As a result, impurities having such a size as blocks the ejection ports 302 to affect the ink ejection through the ejection ports 302 are inhibited from flowing into the bubbling chamber 303. The impurities of such a size are thus unlikely to be present inside the bubbling chamber 303. With the nozzle filters formed as described above, the impurities such as dirt which are present inside the bubbling chamber, if any, are not large enough to affect the ejection. Accordingly, these impurities are considered to exert little adverse effect on the printing, and no recovery process for removing these impurities is required. Thus, if other recovery process, such as preliminary ejection or the like, is not performed, ink ejection is prevented from being affected by impurities such as dirt inside the bubbling chamber. Thus, the ink impacting accuracy can be prevented from being reduced by the impurities such as dirt inside the bubbling chamber. Furthermore, since the need for the recovery process such as the preliminary ejection is eliminated, the associated ink consumption can be reduced.

Besides the above-described recovery process of expanding and transferring the bubble from the nozzle as in the case of the present embodiment, another recovery process such as the preliminary ejection may be carried out.

Now, description will be given of the results of tests in which the printing apparatus with the above-described print head applied thereto was checked for recoverability.

First, to intentionally generate a nozzle bubble inside the bubbling chamber in the print head according to the present embodiment, an impact of acceleration about 30 G was applied to a rear surface of the print head H1001 according to the present embodiment. Subsequently, a process of recovering the print head H1001 according to the present embodiment was carried out by heating the print head to expand and remove the nozzle bubble 308. Specifically, such a short pulse as was insufficient to cause the ink to be ejected was applied to the electrothermal transducing element 301 to heat the ink until the temperature of the ink reached about 90° C. The temperature was then retained for 20 seconds. Then, the recovery process was carried out on the print head H1001, which was then used to perform printing. A print pattern used was a mixture of ruled lines, texts, and the like. As a result, non-ejection or deflection of ink ejection direction caused by the bubble remaining in the bubbling chamber 303 was not observed.

Figure 6C:
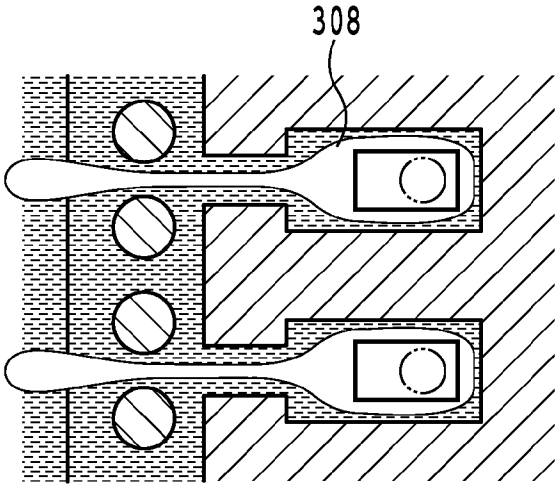
FIGS. 6A to 6C are diagrams illustrating movement of bubbles observed when a recovery process is carried out in the print head in FIG. 5.
Figure 6B:
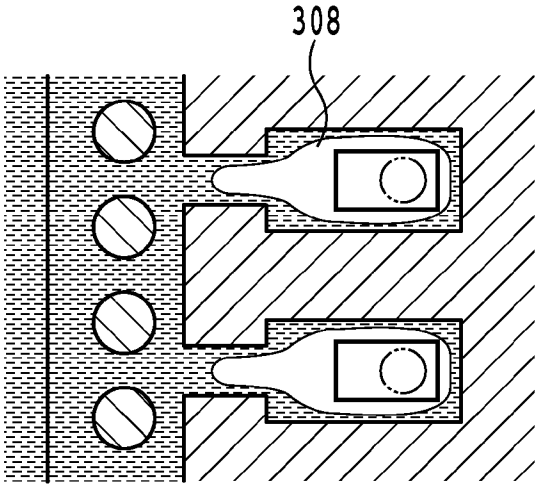
Figure 6A:
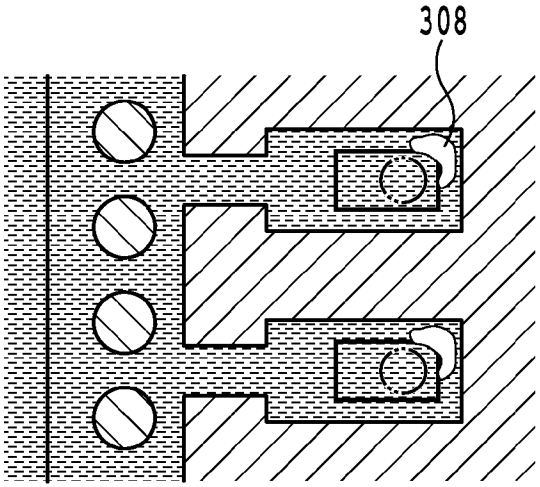

Subsequently, the print head H1001 with the recovery process carried out thereon was observed for the condition of the nozzle bubbles. FIGS. 6A to 6C show sectional views of the nozzle 310 in the print head H1001 in this condition. As shown in FIG. 6A, before the interior of the bubbling chamber 303 in the print head H1001 was heated, the nozzle bubble 308 resulting from the impact was observed in the bubbling chamber 303. Then, as the bubbling chamber 303 was heated to a higher temperature, the nozzle bubble 308 in the bubbling chamber 303 was observed to grow gradually as shown in FIG. 6B. When the temperature of the print head H1001 reached about 90° C., the grown nozzle bubble 308 transferred through the channel between the nozzle filters 306 toward the ink supply port 307 as shown in FIG. 6C. Finally, a phenomenon was observed in which the expanded bubble passed through the ink supply port 307 and was collected.

The above-described phenomenon is considered to occur because the positional relationship between the nozzle 310 and nozzle filter 306 in the print head H1001 is such that the nozzle 310 and the nozzle filter 306 are arranged so as to satisfy the relationship L1≦L2. The positional relationship is considered to cause the nozzle bubble 308 grown by the heating to transfer toward the area between the nozzle filters 306, which offers lower flow resistance, instead of the area between the ink channel inlet 311 and the nozzle filter 306, which offers higher flow resistance.

Figure 7A:
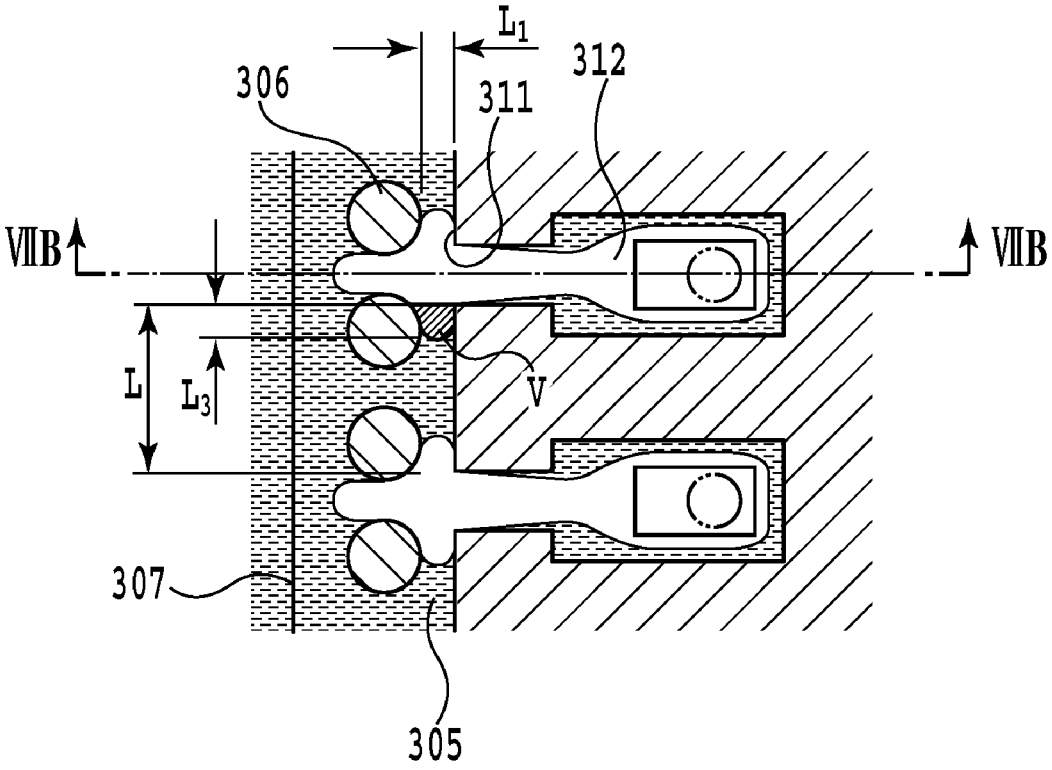
FIG. 7A is a plan view of the print head, showing the embodiment of the present invention.
Figure 7B:
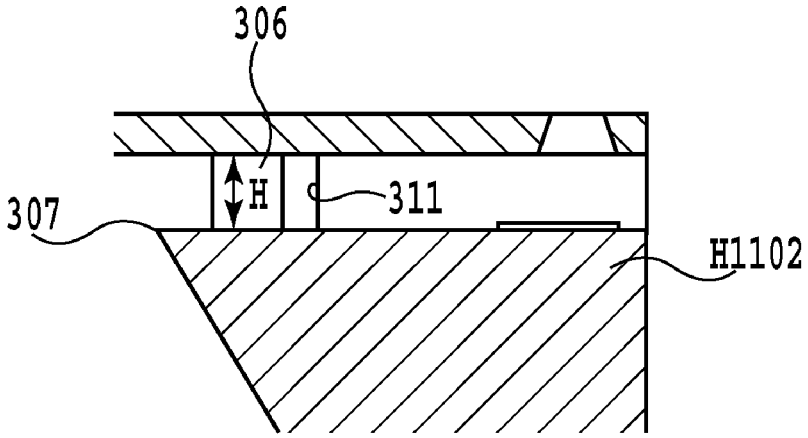
FIG. 7B is a sectional view of the print head in FIG. 7A taken along line VIIB-VIIB in FIG. 7A.

FIG. 7A shows the moment when the volume of the bubble reached the maximum value. FIG. 7B is a sectional view of the print head in FIG. 7A taken along line VIIB-VIIB in FIG. 7A. Here, the volume of that part of a bubble 312 with the maximum volume which is present between the ink channel inlet 311 and the nozzle filter 306 and which grows toward the adjacent nozzle is defined as V. A distance between the ink channel inlets 311 of the adjacent nozzles is defined as L. The length of the bubble in the direction toward the adjacent nozzle from the ink channel inlet 311 is defined as L3. As shown in FIG. 7B, in an area between the ink supply port 307 and the ink channel in which the ink can be present, a height from the front surface of the print element substrate H1101 to a ceiling of the ink channel is defined as H.

Here, when the following formula holds true, the bubbles from the adjacent nozzles fail to be combined with each other at the moment when the bubble reaches the maximum value.

$$(H \times L \times L1)/2 > V \quad \text{(Formula 1)}$$

That is, the bubbles fail to be combined with each other when Formula 2 into which Formula 1 is converted holds true.

$$L > (2V/(H \times L1)) \quad \text{(Formula 2)}$$

In the formulae, V is approximated by the volume of a rectangle, and specifically, V=L1×H×L3. Thus, provided that L3<L/2, the bubbles from the adjacent nozzles fail to be combined with each other. Consequently, Formula 1 is derived. The reason why the bubbles from the adjacent nozzles fail to be combined with each other can also be considered to be that the configuration according to the present embodiment satisfies Formula 2.

Comparative Example

Figure 8:
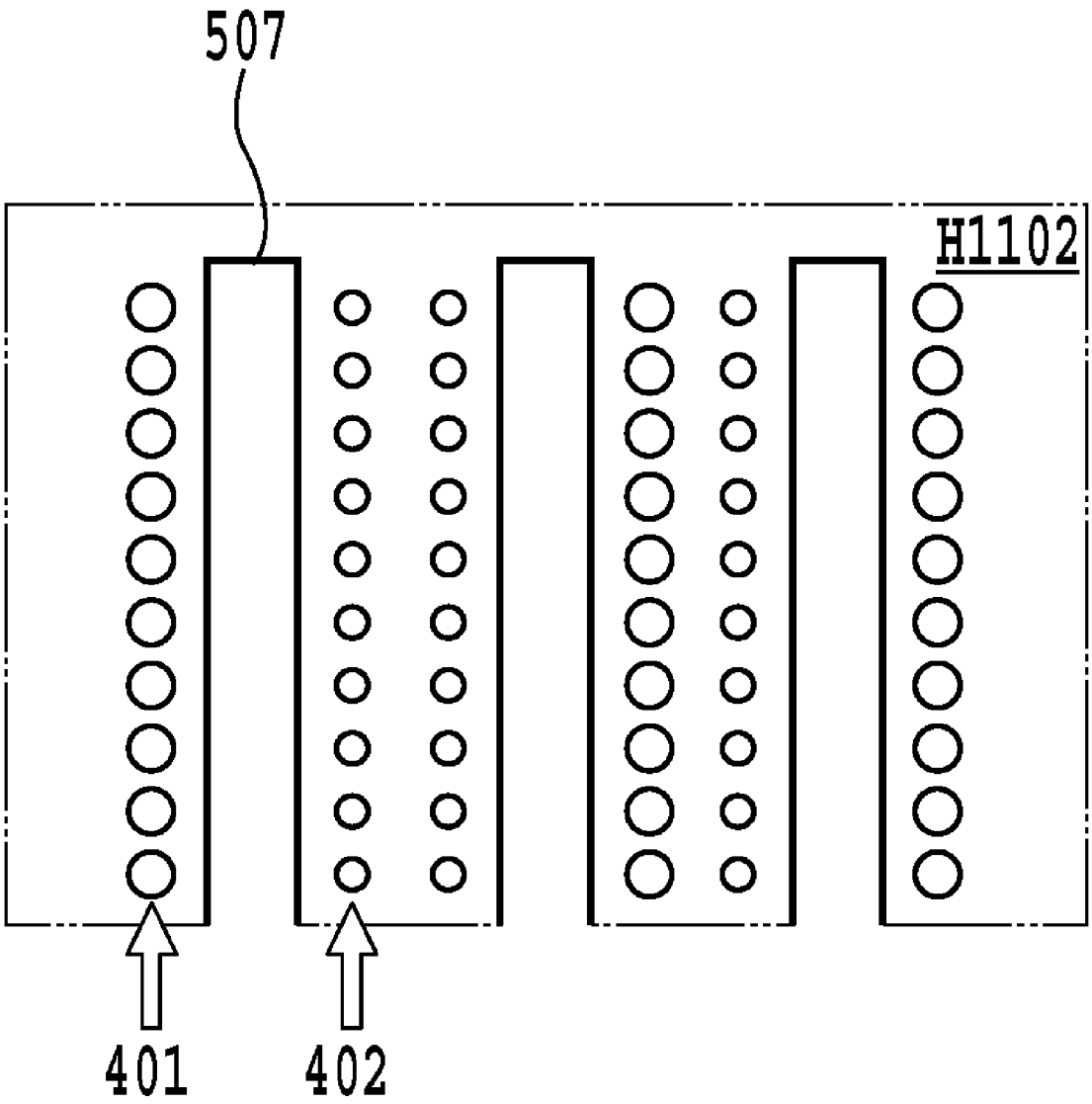
FIG. 8 is a plan view of an ejection port forming surface of a print head in a comparative example for comparison with the print head according to the present invention.

Now, a comparative example for comparison with the print head according to the present invention will be described. FIGS. 8, 9, 10A, 10B, and 10C show schematic diagrams showing a nozzle portion of a print head in the comparative example. FIG. 8 is a diagram showing arrangement of ejection ports observed when a print element substrate H1102 of a print head H1002 is viewed from the direction of the print medium. FIG. 8 also shows the positions of the ejection ports in the print head in the comparative example.

The print head H1002 in the comparative example include two types of ejection ports, that is, first ejection ports through each of which a relatively large amount of ink is ejected, and second ejection ports through each of which a relatively small amount of ink is ejected. In the comparative example, the first ejection port is formed to be able to eject 5 pl of droplets. The first ejection ports are arranged parallel to an ink supply port to form a first ejection port row 401. The second ejection port is formed to be able to eject 2 pl of droplets. The second ejection ports are arranged parallel to the ink supply port to form a second ejection port row 402.

The first ejection port row 401 and the second ejection port row 402 are positioned opposite each other via an ink supply port 507. In this case, the amount of ink droplets ejected through the ejection port need not be 5 pl or 2 pl for all the ejection ports making up each of the ejection port rows. The ejection ports in each ejection port row have only to have a size appropriate to eject substantially about 5 pl or 2 pl of ink droplets. All the ejection port rows are formed parallel to one another. Different types of ink can be supplied through the three ejection ports. The amount of ink ejected through the ejection port per ejection is not limited to 5 pl or 2 pl. A different ejection amount may be set.

Figure 9:
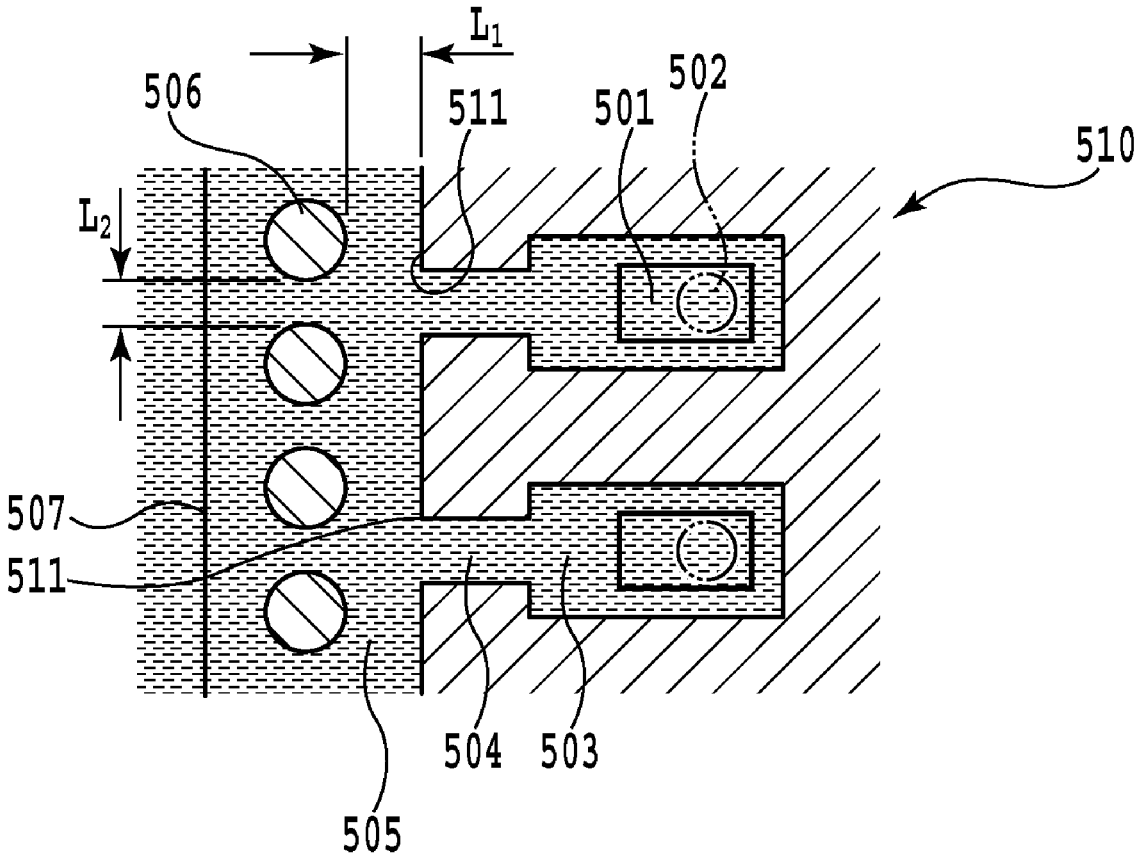
FIG. 9 is an enlarged sectional view of an essential part of the print head in FIG. 8.

FIG. 9 shows an enlarged sectional view of an essential part of a nozzle in the second ejection port row 402. Ink ejection ports 502 making up the second ejection port row 402 are each formed to have an area enabling 2 pl of ink droplets to be ejected through the ink ejection port 502. Specifically, the ink ejection port 502 is shaped like a circle of diameter 10.4 μm. A bubbling chamber 503 which communicate with the ink ejection port, an ink channel 504, and an electrothermal transducing element 501 have dimensions adjusted to the ink ejection port. Specifically, the bubbling chamber 503 is formed to have a width of 22 μm. The ink channel 504 is formed to have a width of 11 μm. The electrothermal transducing element 501 is shaped like a rectangle of 13×22.4 μm. The ink channel 504 is formed to communicate with a common liquid chamber 505. The common liquid chamber 505 is positioned closer to a front surface side corresponding to a direction in which the ink is ejected, than the ink supply port 507. The common liquid chamber 505 is formed so as to cover the ink supply port 507.

A nozzle filter 506 is located in an area inside the common liquid chamber 505 and outside the ink supply port 507. The nozzle filter 506 is a cylinder of diameter 14 μm. Two nozzle filters 506 are formed per nozzle. The nozzle filters 506 are provided in order to, if the ink supplied to the nozzle through the ink supply port 307 contains dirt or the like, trap and inhibit the dirt from flowing into the nozzle.

A distance between the ink channel inlet 511 and the nozzle filter 506 is defined as L1, and a distance between the adjacent nozzle filters 506 is defined as L2. Then, in the comparative example, the print head H1002 is formed such that L1 is 14 μm and L2 is 7 μm. Thus, in the comparative example, the print head H1002 is formed so as to satisfy a relationship L1>L2. In the comparative example, three types of ink in cyan, magenta, and yellow are set to be ejected.

The print head H1002 was used to carry out the recovery process, and was thereafter checked for recoverability. First, to intentionally generate a nozzle bubble 508 inside the print head H1002, an impact of about 30 G was applied to the print head H1002. Subsequently, a heating recovery process was carried out by heating the print head to expand and remove the nozzle bubble 508 inside the bubble chamber 503. Specifically, such a short pulse as was insufficient to cause the ink to be ejected was applied to the electrothermal transducing element 501. The print head was heated until the temperature inside the print head reached about 90° C. This condition was held for 20 seconds. Then, the print head H1002 was used to perform printing. A print pattern used was a mixture of ruled lines, texts, and the like. As a result, slight non-ejection or deflection of ink ejection direction was observed in a print image obtained.

Figure 10C:
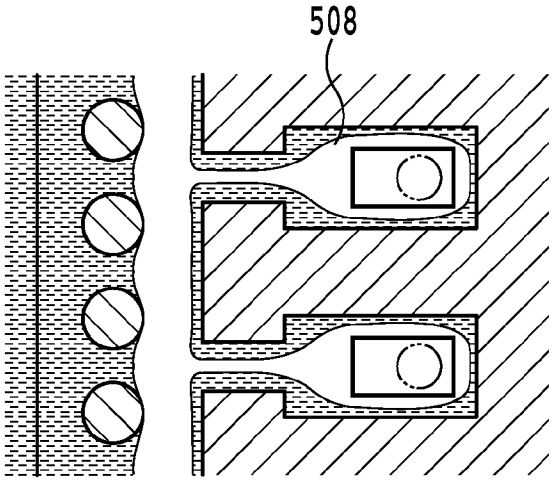
FIGS. 10A to 10C are diagrams illustrating movement of bubbles observed when a recovery process is carried out in the print head in FIG. 9.
Figure 10B:
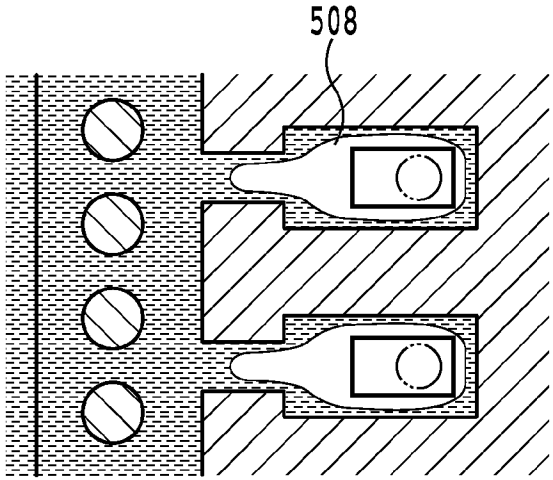
Figure 10A:
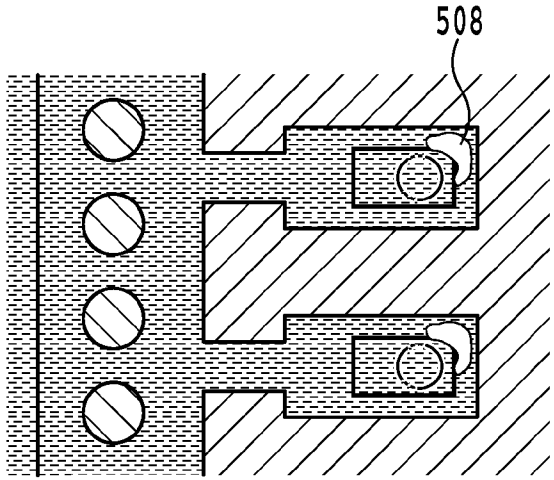

Subsequently, during the recovery process of heating the ink to expand the bubble and then removing the bubble, the condition of the nozzle bubble 508 was observed. This is shown in FIGS. 10A to 10C. Before the heating, the nozzle bubble 508 was observed in the bubbling chamber 503 as shown in FIG. 10A. Then, as the bubbling chamber 503 was heated to a higher temperature, the nozzle bubble 508 in the bubbling chamber 503 was observed to grow gradually as shown in FIG. 10B. When the temperature of the print head reached about 90° C., a phenomenon was locally observed in which the grown nozzle bubbles 508 from the adjacent nozzles were combined with each other as shown in FIG. 10C. This is considered to be because of the relationship L1>L2, where the distance between the ink channel inlet and the nozzle filter is defined as L1 and the distance between the adjacent nozzle filters is defined as L2.

In this case, the channel width L1 of the channel between the ink channel inlet 511 and the nozzle filter 506 is larger than that L2 of the channel between the adjacent nozzle filters 506. Consequently, the flow resistance in the channel between the adjacent nozzle filters 506 is higher than that in the channel between the ink channel inlet 511 and the nozzle filter 506. Thus, the expanded bubble 508 flows through the channel between the ink channel inlet 511 and the nozzle filter 506 instead of the channel between the nozzle filters 506. As a result, the bubble 508 transfers along a length direction of the ink supply port 507. Thus, the bubbles transferring into the common liquid chamber through the adjacent nozzles are combined with each other and remain inside the nozzles 503. This is considered to be because the bubble grown by the heating tends not to flow through the area between the nozzle filters 506, which offers high flow resistance, but to transfer, along the length direction of the ink supply port, through the area between the ink channel inlet 511 and the noise filter 506, which offers low flow resistance.

The reason why in the comparative example, the bubbles from the adjacent nozzles are combined with each other can also be considered to be that the configuration in the comparative example satisfies Formula 3.

$$L \leqq (2V/(H \times L1)) \quad \text{(Formula 3)}$$

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2008-029225, filed Feb. 8, 2008, and 2009-000868, filed Jan. 6, 2009 which are hereby incorporated by reference herein in their entirety.

What is claimed is:

1. A liquid ejection head comprising:

a plurality of nozzles each including:

an energy acting chamber;

a print element located in the energy acting chamber to generate energy applied to a liquid stored in the energy acting chamber;

an ejection port which communicates with the energy acting chamber and through which the liquid to which the energy is applied by the print element is ejected; and a liquid channel through which the liquid supplied via a liquid supply port and stored in the energy acting chamber passes, wherein a plurality of column-shaped nozzle filters are provided between the liquid supply port and the liquid channel to separate an impurity contained in the liquid, from the liquid, when a distance, in a direction from the liquid supply port toward the energy acting chamber, between the nozzle filter and a liquid channel inlet that is closest to the liquid supply port in the liquid channel is defined as L1, and a distance between the nozzle filters is defined as L2, a relationship between L1 and L2 satisfies L1≦L2, wherein when volume of a bubble is maximum in the liquid which is present between the liquid channel inlet and the nozzle filter, (i) the volume of a part of the bubble which is grown in a direction in which a plurality of the nozzle filters are arranged, from the liquid channel inlet, is defined as V, (ii) a distance between adjacent liquid channel inlets is defined as L, and (iii) a distance, in an area between the liquid supply port and the liquid channel, from a surface of a substrate on which the print element is formed to a ceiling of the liquid channel is defined as H, and wherein L>(2V/(H×L1)) is satisfied.

2. The liquid ejection head according to claim 1, wherein two nozzle filters are assigned to the one nozzle, and a distance between the two nozzle filters is defined as L2.

3. The liquid ejection head according to claim 2, wherein the ejection port is shaped like a circle, and the distance L2 between the two nozzle filters is smaller than an ejection port diameter.

4. A liquid ejection head comprising:

a plurality of nozzles each including:

an energy acting chamber;

a print element located in the energy acting chamber to generate energy applied to a liquid stored in the energy acting chamber;

an ejection port which communicates with the energy acting chamber and through which the liquid to which the energy is applied by the print element is ejected; and a liquid channel through which the liquid supplied via a liquid supply port and stored in the energy acting chamber passes, wherein a plurality of column-shaped nozzle filters are provided between the liquid supply port and the liquid channel so that the liquid supplied to the energy acting chamber through the liquid supply port is passed between the nozzle filters to separate an impurity contained in the liquid, from the liquid, wherein flow resistance in a channel between the nozzle filter and the liquid channel inlet which is closest to the liquid supply port in the liquid channel is higher than that in a channel between the nozzle filters, when a distance, in a direction from the liquid supply port toward the energy acting chamber, between the nozzle filter and a liquid channel inlet that is closest to the liquid supply port in the liquid channel is defined as L1, and a distance between the nozzle filters is defined as L2, a relationship between L1 and L2 satisfies L1≦L2, wherein when a volume of a bubble is maximum in the liquid which is present between the liquid channel inlet and the nozzle filter, (i) the volume of a part of the bubble which is grown, in a direction in which a plurality of the nozzle filters are arranged, from the liquid channel inlet, is defined as V, (ii) a distance between adjacent liquid channel inlets is defined as L, and (iii) a distance, in an area between the liquid supply port and the liquid channel, from a surface of a substrate on which the print element is formed to a ceiling of the liquid channel is defined as H, and wherein L>(2V/(H×L1)) is satisfied.

* * * * *